US006865792B2

(12) United States Patent
Kash

(10) Patent No.: US 6,865,792 B2
(45) Date of Patent: Mar. 15, 2005

(54) METHOD FOR MAKING A WELL PERFORATING GUN

(76) Inventor: Edward Cannoy Kash, 11660 Brittmore Park Dr., Houston, TX (US) 77041

( * ) Notice: Subject to any disclaimer, the term of this patent is extended or adjusted under 35 U.S.C. 154(b) by 0 days.

(21) Appl. No.: 10/610,740

(22) Filed: Jul. 1, 2003

(65) Prior Publication Data

US 2004/0216297 A1 Nov. 4, 2004

Related U.S. Application Data

(63) Continuation-in-part of application No. 10/370,142, filed on Feb. 18, 2003.

(51) Int. Cl.[7] ..... B23P 19/04
(52) U.S. Cl. ..... 29/455.1; 166/297; 175/4.5
(58) Field of Search ..... 29/455.1, 450, 29/235, 236, 428, 454, 506; 175/4.51, 4.6, 4.5, 4.53; 166/297, 298, 55; 285/425, 145.4

(56) References Cited

U.S. PATENT DOCUMENTS

| | | | | | |
|---|---|---|---|---|---|
| 2,649,046 | A | | 8/1953 | Davis | 102/310 |
| 2,750,885 | A | | 6/1956 | Schlumberger | 175/4.6 |
| 2,980,017 | A | | 4/1961 | Castel | 175/4.6 |
| 4,523,649 | A | * | 6/1985 | Stout | 175/4.51 |
| 4,889,183 | A | * | 12/1989 | Sommers et al. | 166/55 |
| 5,095,999 | A | * | 3/1992 | Markel | 175/4.6 |
| 5,775,426 | A | | 7/1998 | Snider | 166/308.1 |
| 5,960,894 | A | | 10/1999 | Lilly | 175/4.6 |
| 6,336,506 | B2 | | 1/2002 | Wesson | 166/308.1 |
| 6,347,673 | B1 | * | 2/2002 | Dailey | 175/4.6 |
| 6,520,258 | B1 | | 2/2003 | Yang | 166/297 |
| 6,679,327 | B2 | | 1/2004 | Sloan | 166/297 |
| 2002/0134585 | A1 | | 9/2002 | Walker | 175/4.51 |

* cited by examiner

*Primary Examiner*—David P. Bryant
*Assistant Examiner*—Stephe Kenny
(74) *Attorney, Agent, or Firm*—Wendy Buskop; Buskop Law Group, P.C.

(57) ABSTRACT

The invention relates to a method to make a perforating gun for use in oil and natural gas wells comprising the steps of: obtaining a length of a first tube; cutting scallop holes into the first tube forming an outer layer; placing the outer layer in a holder; cutting a second tube to the approximate length of the outer layer; pulling the second tube into the outer layer forming a laminate structure having a first and second end; repeating the process for a desired number of layers in the laminate structure; machining internal structures into the laminate structure; inserting the loading tube into the laminate structure; and forming thread protectors in the first end and the second end of the laminate structure.

28 Claims, 13 Drawing Sheets

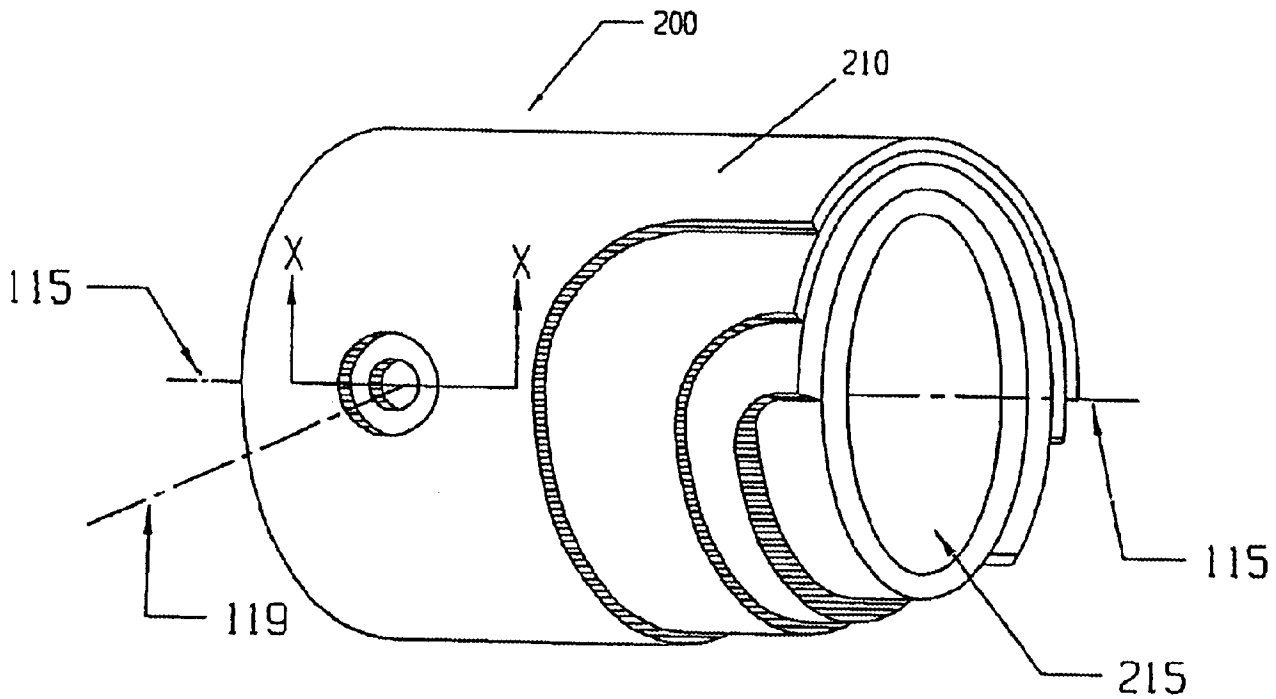
FIGURE 8
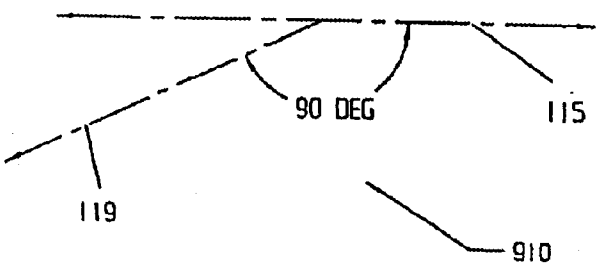

METHOD FOR MAKING A WELL PERFORATING GUN

This application is a continuation-in-part of application of Ser. No. 10/370,142 filed Feb. 18, 2003, Entitled, "WELL PERFORATING GUN".

BACKGROUND

Typically, the major component of the gun string is the "gun carrier" tube component (herein after called "gun") that houses multiple shaped explosive charges contained in lightweight precut "loading tubes" within the gun. The loading tubes provide axial circumferential orientation of the charges within the gun (and hence within the well bore). The tubes allow the service company to preload charges in the correct geometric configuration, connect the detonation primer cord to the charges, and assemble other necessary hardware. The assembly is then inserted into the gun as shown in FIG. 2. Once the assembly is complete, other sealing connection parts are attached to the gun and the completed gun string is lowered into the well bore by the conveying method chosen.

The gun is lowered to the correct down-hole position within the production zone, and the chares are ignited producing an explosive high-energy jet of very short duration. This explosive jet perforates the gun and well casing while fracturing and penetrating the producing strata outside the casing. After detonation, the expended gun string hardware is extracted form the well or release remotely to fall to the bottom of the well. Oil or gas (hydrocarbon fluids) then enters the casing through the perforations. It will be appreciated that the size and configuration of the explosive charge, and thus the gun string hardware, may vary with the size and composition of the strata, as well as the thickness and interior diameter of the well casing.

Currently, cold-drawn or hot-drawn tubing is used for the gun carrier component and the explosive charges are contained in an inner, lightweight, precut loading tube. The gun is normally constructed from a high-strength alloy metal. The gun is produced by machining connection profiles on the interior circumference of each of the guns ends and "scallops," or recesses, cut along the gun's outer surface to allow protruding extensions or "burrs" created by the explosive discharge through the gun to remain near or below the overall diameter of the gun. This method reduces the chance of burrs inhibiting extraction or dropping the detonated gun. High strength materials are used to construct guns because they must withstand the high energy expended upon detonation. A gun must allow explosions to penetrate the gun body, but not allow the tubing to split or otherwise lose its original shape Extreme distortion of the gun may cause it to jam within the casing. Use of high strength alloys and relatively heavy tube wall thickness has been used to minimize this problem.

Guns are typically used only once. The gun, loading tube, and other associated hardware items are destroyed by the explosive charge. Although effective, guns are relatively expensive. Most of the expense involved in manufacturing guns is the cost of material. These expenses may account for as much as 60% or more of the total cost of the gun. The oil well service industry has continually sought a method or material to reduce the cost while also seeking to minimize the possibility of misdirected explosive discharges or jamming of the expended gun within the well.

Although the need to ensure gun integrity is paramount, efforts have made to use lower cost steel alloys through heat-treating, mechanical working, or increasing wall thickness in lower-strength but less expensive materials. Unfortunately, these efforts have seen only limited success. Currently, all manufacturers of guns are using some variation of high strength, heavy-wall metal tubes.

FIELD OF THE INVENTION

Well completion techniques normally require perforation of the ground formation surrounding the borehole to facilitate the flow if interstitial fluid (including gases) into the hole so that the fluid can be gathered. In boreholes constructed with a casing such as steel, the casing must also be perforated. Perforating the casing and underground structures can be accomplished using high explosive charges. The explosion must be conducted in a controlled manner to produce the desired perforation without destruction or collapse of the well bore.

Hydrocarbon production wells are usually lined with steel casing. The cased well, often many thousands of feet in length, penetrates varying strata of underground geologic formations. Only a few of the strata may contain hydrocarbon fluids. Well completion techniques require the placement of explosive charges within a specified portion of the strata. The charge must perforate the casing wall and shatter the underground formation sufficiently to facilitate the flow of hydrocarbon fluid into the well as shown in FIG. 1. However, the explosive charge must not collapse the well or cause the well casing wall extending into a non-hydrocarbon containing strata to be breached. It will be appreciated by those skilled in the industry that undesired salt water is frequently contained in geologic strata adjacent to a hydrocarbon production zone, there fore requiring accuracy and precision in the penetration of the casing.

The explosive charges are conveyed to the intended region of the well, such as an underground strata containing hydrocarbon, by multi-component perforation gun system ("gun systems," or "gun string"). The gun string is typically conveyed through the cased well bore by means of coiled tubing, wire line, or other devices, depending on the application and service company recommendations. Although the following description of the invention will be described in terms of existing oil and gas well production technology, it will be appreciated that the invention is not limited to those application.

SUMMARY OF THE INVENTION

The invention relates to a method to make a perforating gun for use in oil and natural gas wells comprising the steps of: obtaining a length of a first tube; cutting scallop holes into the first tube forming an outer layer; placing the outer layer in a holder; cutting a second tube to the approximate length of the outer layer; pulling the second tube into the outer layer forming a laminate structure having a first and second end; repeating the process for a desired number of layers in the laminate structure; machining internal structures into the laminate structure; inserting the loading tube into the laminate structure; and forming thread protectors in the first end and the second end of the laminate structure.

Embodiments of the invention further include a method to make a perforating gun for use in oil and natural gas wells. The method generally includes obtaining a length of a first tube, cutting scallop holes into the first tube forming an outer layer, placing the outer layer in a holder, cutting a second tube to a second length of tube which is the approximate length of the outer layer, wrapping wire around the second length of tube and pulling the second length of tube with the wire disposed thereon into the outer layer forming a laminate structure having a first and second end. The method further includes welding a first end coupling to the first end and the second end coupling to the second end and inserting a loading tube into the laminate structure.

BRIEF DESCRIPTION OF THE DRAWINGS

The accompanying drawings, which are incorporated in and constitute a part of the specification, illustrate preferred embodiments of the invention. These drawings, together with the general description of the invention above and the detailed description of the preferred embodiments below, serve to explain the principals of the invention.

FIG. 8 shows a scallop in the outer layer.

The above general description and the following detailed description are merely illustrative of the subject invention, additional modes, and advantages. The particulars of this invention will be readily suggested to those skilled in the art without departing from the spirit and scope of the invention.

DETAILED DESCRIPTION OF THE INVENTION

The invention disclosed herein incorporates novel engineering criteria into the design and fabrication of well perforating guns. This criterion addresses multiple requirements. First, the gun material's (steel or other metal) ability to withstand high shocks delivered over very short periods of time ("impact strength") created by the simultaneous detonation of multiple explosive charges ("explosive energy pulse" or "pulse") is more important than the material's ultimate strength. This impact strength is measurable and is normally associated with steels with 200low carbon content and/or higher levels of other alloying elements such as chromium and nickel. Second the shock of the explosion transfers its energy immediately to the outside surface of the tubing. Any imperfections, including scallops, will act as stress risers and can initiate cracking and failure.

Figure 1:
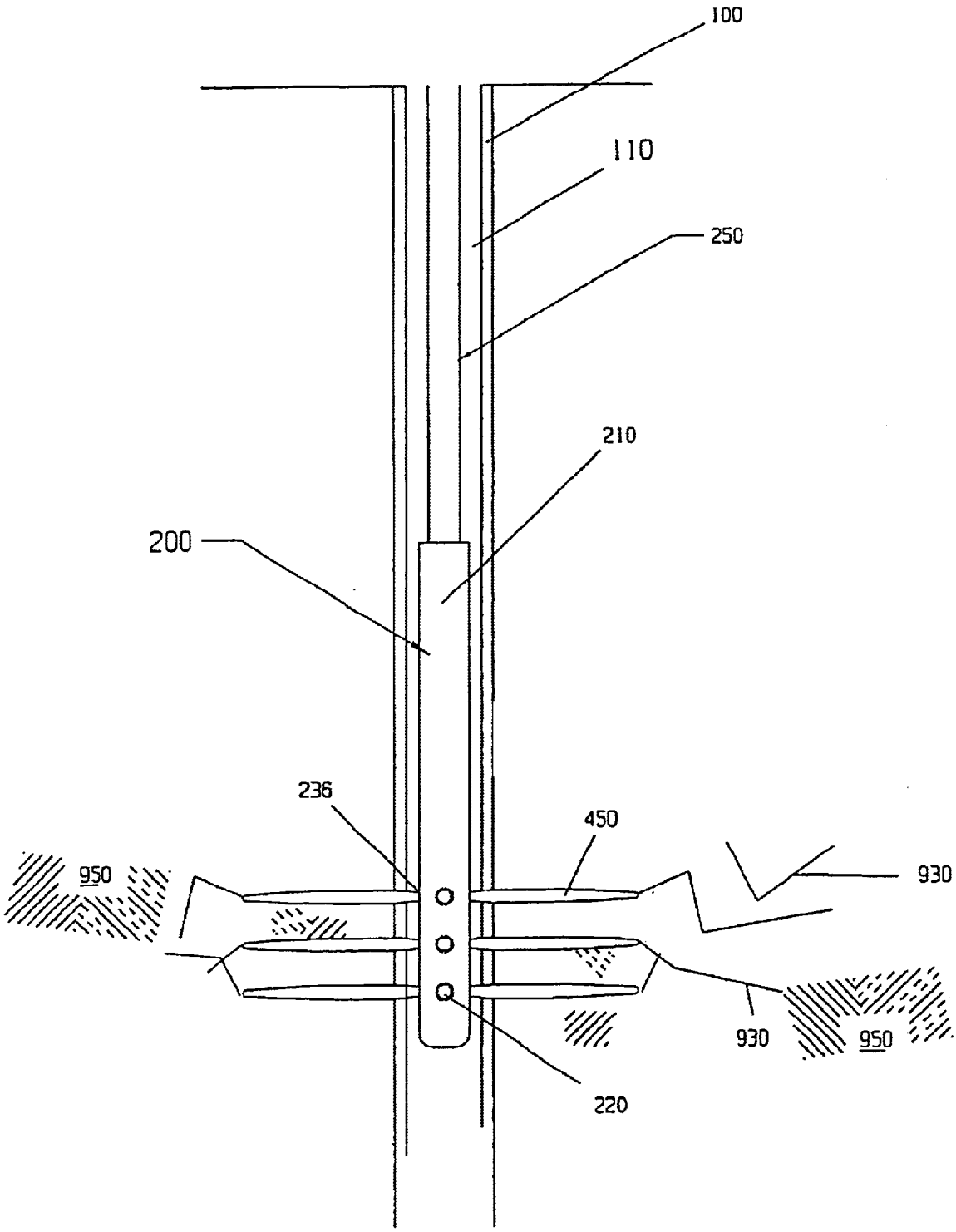
FIG. 1 illustrates the affect of the explosive discharge from a well perforating gun penetrating through the well casing and into the surrounding geologic formation.

FIG. 1 illustrates the basic casing perforation operation in which the tool and fabrication method disclosed in this specification are utilized. The gun 200 is suspended within the well bore 110 by a coil tube or a wire line device 250. The charges (not shown) contained within the gun are oriented in 90 degrees around the circumference of the gun. The explosive gas jet 450 produced by detonation of the charge penetrates 236 through the wall 210 of the gun 200 and well casing 100 creating fractures 930 in the adjacent strata 950. Penetration of the gun wall is intended to occur at machined recesses 220 in the wall 210. The recesses are fabricated in a selected pattern around the circumference of the gun.

It is desirable to use various arrangements or orientations of the charges ("shots") and with varying numbers of charges within a given area ("shot density"). This allows variation in the effect and directionally of the explosive charges. Shots are typically arranged in helical orientation (not shown) around the wall of the gun 200 as well as in straight lines parallel to the axial direction of the gun tube. The arrangements are defined by the application and the design engineers' requirements, but are virtually limitless in variation. Guns are typically produced in increments of 5 feet, with the most common gun being about 20 feet. These guns may hold and fire as many as 21 charges for every foot of gun length. Perforation jobs may require multiple combinations of 20-foot sections, which are joined together end to end by threaded screw-on connectors.

The invention relates to a method to make a perforating gun for use in oil and natural gas wells comprising the steps of: obtaining a length of a first tube; cutting scallop holes into the first tube forming an outer layer; placing the outer layer in a holder; cutting a second tube to the approximate length of the outer layer; pulling the second tube into the outer layer forming a laminate structure having a first and second end; repeating the process for a desired number of layers in the laminate structure; machining internal structures into the laminate structure; inserting the loading tube into the laminate structure; and forming thread protectors in the first end and the second end of the laminate structure.

More specifically, the invention relates to an embodiment wherein the pulling of the second tube into the first tube is accomplished using a gear reduced drive and chain mechanism.

In a preferred embodiment, the method comprises using a length of first tube between 1 foot and 40 feet. A length of second tube is preferably between 1 foot and 40 feet. In still another preferred embodiment, the first and second tubes have an outer diameter ranging between 1.5 inches and 7 inches.

Part of the invention relates to the cutting of the scallops in the outer layer of the invention. This cutting can be performed by either a laser, a drill or a mill. The scallops are preferably cut at a density of at least 1 per foot of scallops.

In pulling the two tubes together, the method contemplates using a holder which is a heavy walled tube that is at least 0.020 larger in diameter than the first tube.

As an additional step, the invention contemplates forming the thread protectors on a lathe prior to insertion on the ends of the laminate.

The inventive device made by this method is described in more detail below.

Figure 7:
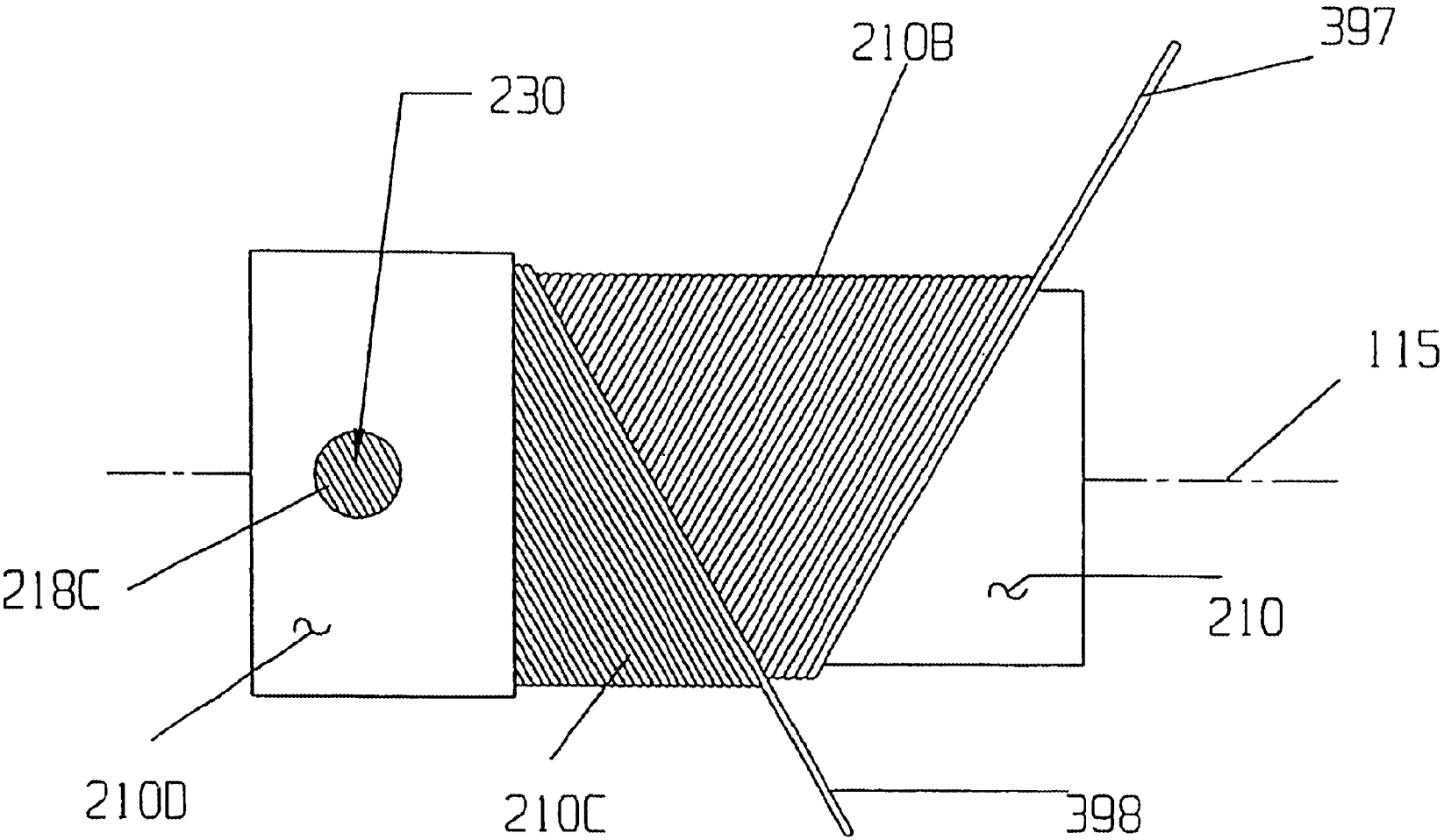
FIG. 7 illustrates an embodiment of the invention utilizing precut holes and wrapped layers.

FIG. 7 illustrates the construction of a gun wall 210 comprised of four material layers (210A, 210B, 210C and 210D). The orientation of each layer is parallel or at a constant radius to the longitudinal axis 115 of the gun 200 and the well bore (not shown). The thickness of each layer or tube 231D, 231C, 231B and 231A may be varied. The diameter of the annulus 215 formed within the inner tube may also be varied. The outer surface of each respective tube layer may be varied in construction to facilitate binding and retard delamination. Such designs may facilitate the strength characteristics of the gun wall in alternate directions, such as traverse or longitudinal directions. It is known that multi-layered constructions can have numerous advantageous over conventional, monolithic material constructions. It will be appreciated that this invention does not limit the number of layers, the composition of individual layers, or the manner in which layers are assembled or constructed. Further, the invention is not limited to the use of a binder or laminating agent between material layers; for example the outer surface 218A on the inner most layer 210A and the inner surface of the next out layer.

It will be appreciated that lamination of multiple layers of the same or differing materials may be used to enhance the performance over a single layer of material without increasing thickness. Use of fibrous materials, such as high strength carbon, graphite, silica based fibers and coated fibers are included within the scope of this invention. Although some embodiments may utilize one or more binding elements between one or more layers of material, the invention is not limited to the use of such binders. Plywood is an example of enhancing material properties by layering wood to produce a material that is superior to a solid wood board of equal thickness. Applications of multi-layered lamination can be subdivided into primary and complex designs. Additional embodiments of the invention are described below.

Figure 2:
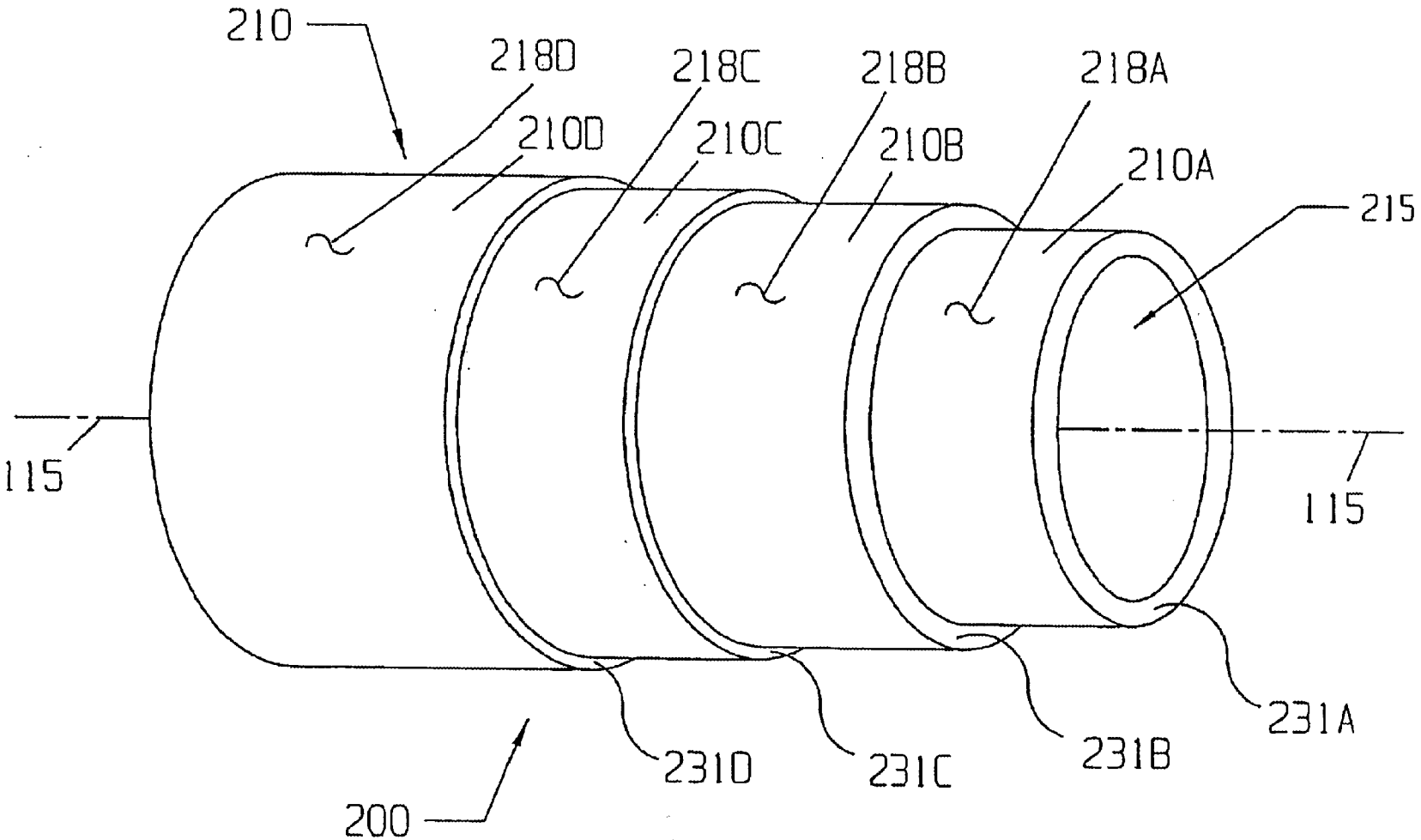
FIG. 2 illustrates an embodiment of the invention comprised of an engineered sequence of layered materials.
Figure 3:
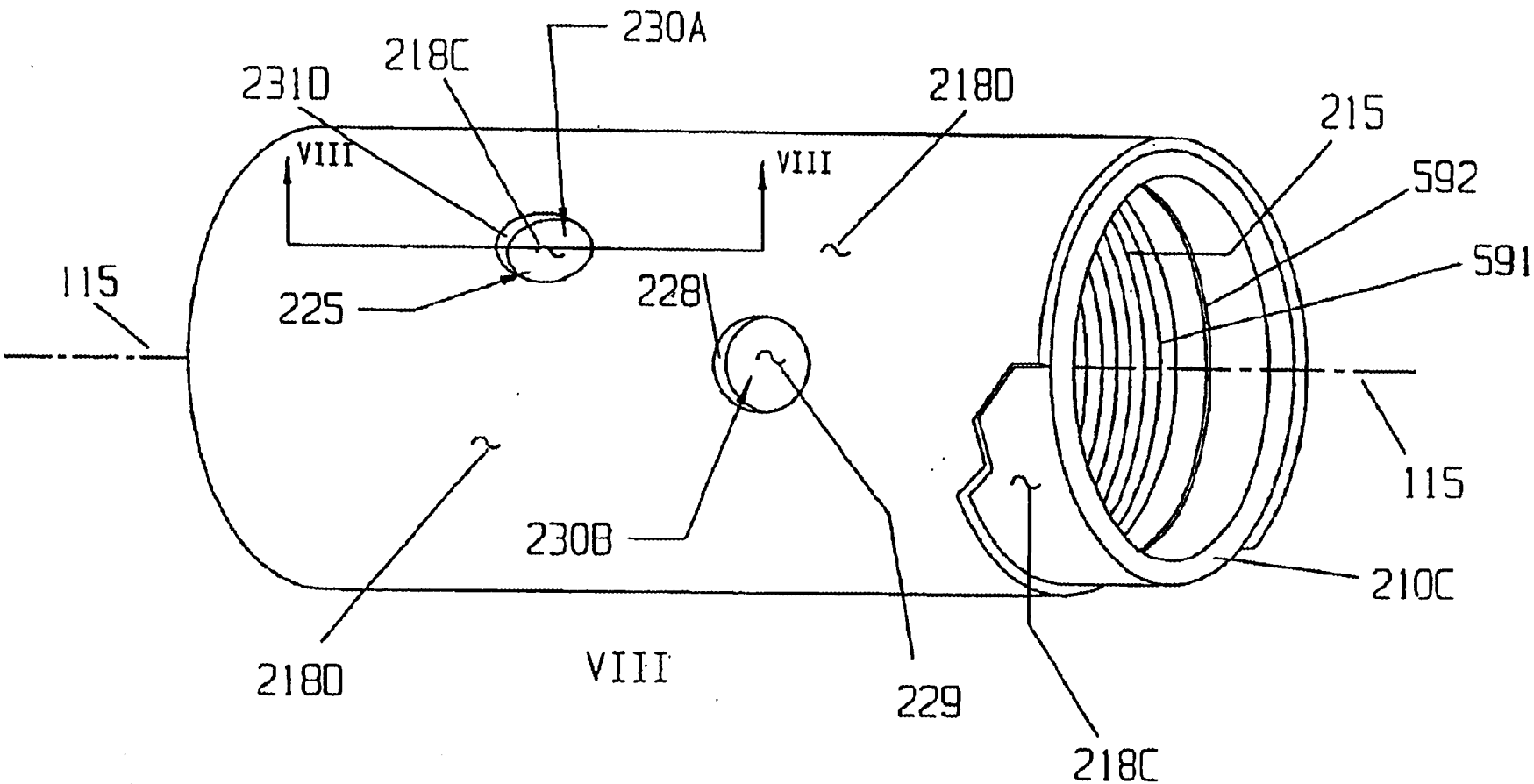
FIG. 3 illustrates an embodiment of the invention showing use of perforated tubing, thereby eliminating machining of scallops.
Figure 4:
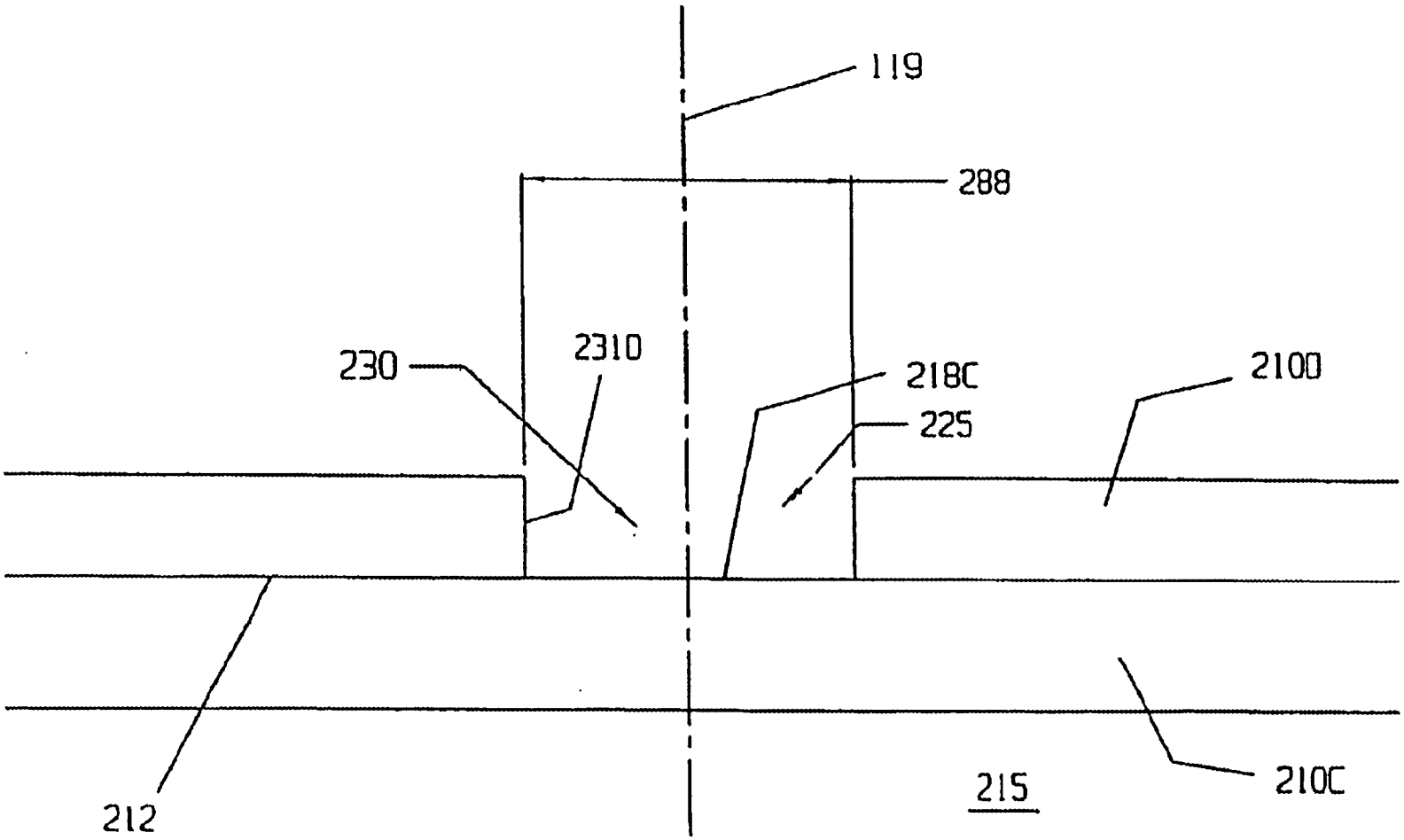
FIG. 4 illustrates a cross section view of the layered wall construction.

FIG. 3 illustrates the primary "tube-within-a-tube" design, similar to the embodiment of the invention illustrated in FIG. 2 and having a longitudinal axis 115. The outer layer 210D is a cylinder or tube in which holes 230A and 230B have been cut through the thickness of the cylinder wall 231D. The diameter of the outer cylinder 210D is approximately equal to the outer diameter of the next inner cylinder 210C. In the embodiment illustrated in FIG. 3, there are no holes cut through the walls of the next inner cylinder 210C. Therefore, the combined cylinder, comprising the "tube-within-a-tube" of 210D and 210C, has the approximate physical shape of the prior art single walled gun having recesses or scallops machined into the outer surface of the wall. In a preferred embodiment of the invention, holes 230A and 230B are cut through the outer cylinder wall 210D prior to assembly of the two cylinders 210C and 210D. The line VIII—VIII designates the location of the cross sectional view illustrated in FIG. 4. FIG. 4 shows a portion of the inner cylinder wall 210C and its relationship with the outer wall 210D and annulus 215. The illustration does not; however depict the radial curvature of each layer. The diameter of the hole 288 may be varied. The axis 119 of the resulting hole 230 may be orthogonal to the longitudinal axis (115 of FIG. 3).

In the structure of the invention shown in FIG. 4, the thickness 231D of outer cylinder wall 230D forms the side wall (228 in FIG. 8) of the recess 225. The outer surface 218C of the next inner cylinder 230C forms the bottom (229 in FIG. 3) of the recess or scallop 225.

It will be readily appreciated that the composition of the several layers or cylinders might differ. Also the thickness and number of layers might be varied, depending upon the requirements of the specific application. The cutting of holes can be accomplished before assembly, thereby eliminating the need for machining.

FIG. 3 also illustrates the ability to perform machining or other fabrication on the individual cylinder components prior to assembly into the completed unit. For example, machining of connector structures can be performed on the inner cylinders individually prior to being inserted or pulled into the larger cylinders. These structural components may be machined threads, seal bores, etc. FIG. 8 illustrates a design that incorporates a machined connection end components 591 and 592 on the innermost tube 210C of a multilayered tube construction.

As discussed above, it is not necessary that the interface (212 in FIG. 4) of the surfaces of the inner and outer tubes or cylinders be bound or otherwise mechanically attached together. An advantage to this design is its simplicity and ease of manufacture. Each of the tubes may have different chemical and mechanical characteristics, depending on the performance needs of the perforation work. Alternatively, each tube can be made of the same material. In another variation, layers of tubing can be made of the same material but oriented differently to achieve the desired properties (similar to the mutually orthogonal layering of plywood). One further variation can b implemented by offsetting a seam of each cylinder or tube layer created in the manufacturing process by rolling flat material into a tube.

One variation of the embodiment illustration in FIG. 3 might include an inner tube of high-strength material (such as the high-strength, alloy metals currently used for guns) and an outer tube of mild steel.

Figure 5:
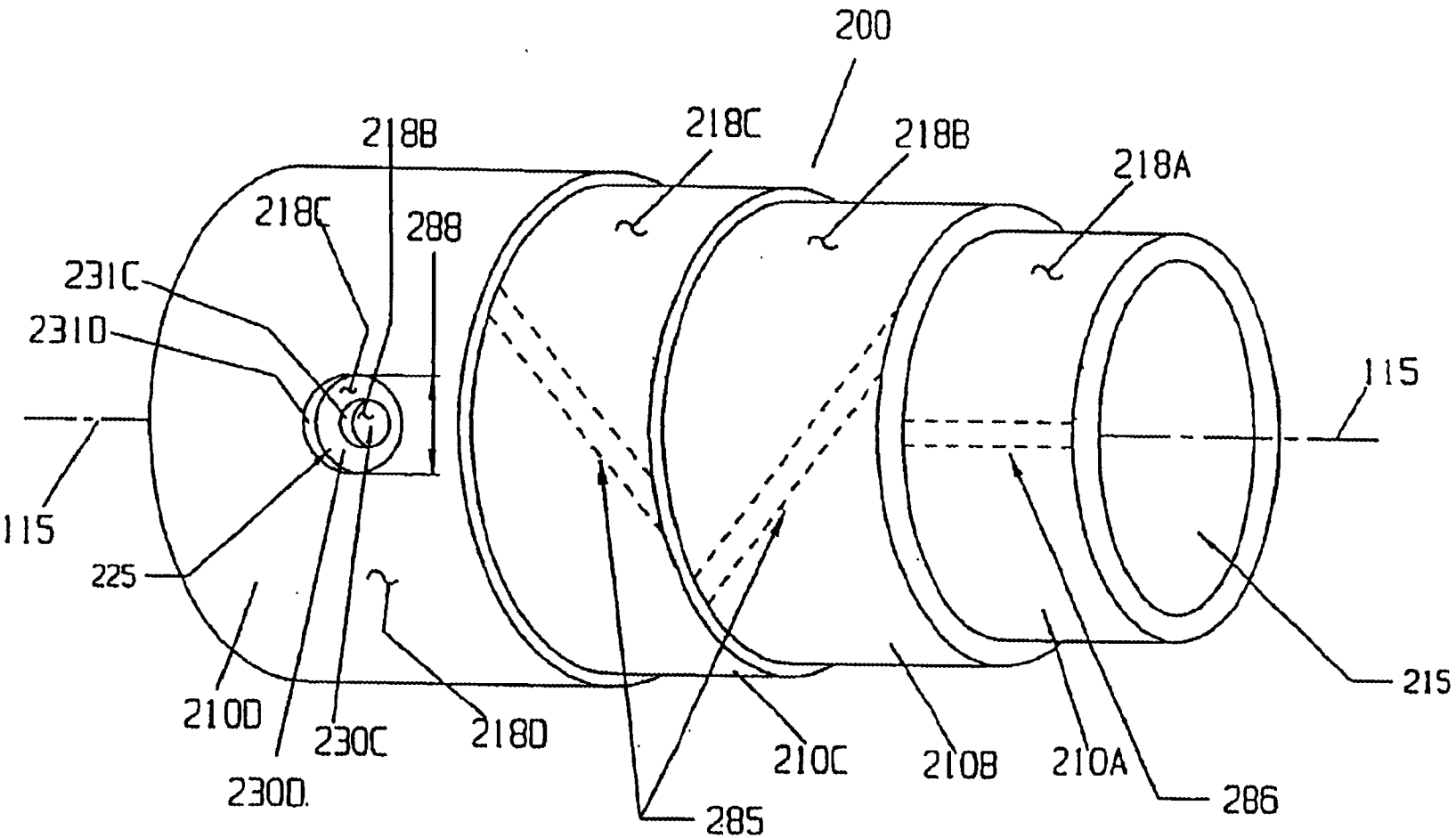
FIG. 5 illustrates a detailed embodiment of the invention employing laminates for extra strength.

FIG. 5 illustrates an embodiment of the invention in which the gun has four material layers (210D, 210C, 210B and 210A). The invention, however, is not limited to four layers. The multilayer design might consist of "tube-within-a-tube" fabrication or the wrapping of material around the outer surface of an inner tube maintaining a relative uniform radius about a central axis 115. The inner tube defines the area of the tube annulus 215. The tubing layers may be seamless or rolled. It will be readily appreciated that layering material can be wrapped in various orientations 285 and 286 to provide enhanced strength. Two layers 210C and 210B are shown helically wrapped 285 at a radius around the longitudinal axis 115. The next inner layer 210A is shown comprised a rolled tube having a seam parallel to the longitudinal axis. It will also be appreciated that the wrapping might include braiding or similar woven construction of material. FIG. 5 also illustrates that any given layer 210C and 210B might consist of a material "tape" wrapped around an inner tube or cylinder 210A. The inner most layer 210A may also be formed around a removable mandrel. The laminations can consist of other metals or non-metals to obtain desirable characteristics. For example, aluminum is a good energy absorber, as is magnesium or lead. This invention does not limit the material choices for the lamination layers or the manufacturing method in obtaining a layer; it specifies of that layers exist and provide advantages over single-wall, monolithic gun designs.

Also illustrated in FIG. 5 are one or more layers 210D and 210C containing holes 230D and 230C having diameters cut prior to assembly. The hole 230D cut into the outer tube 210D has a diameter 288. The axis of the holes can be orthogonal to the longitudinal axis 115 of the gun 200. The tube layer thickness 231D and 231C forms the wall of the recess 225 and the outer surface 218B of the next underlying layer 210B forms the bottom of the recess 225. The architecture of the resulting recess is comparable, but advantageous to, the prior art machined scallops.

Figure 6:
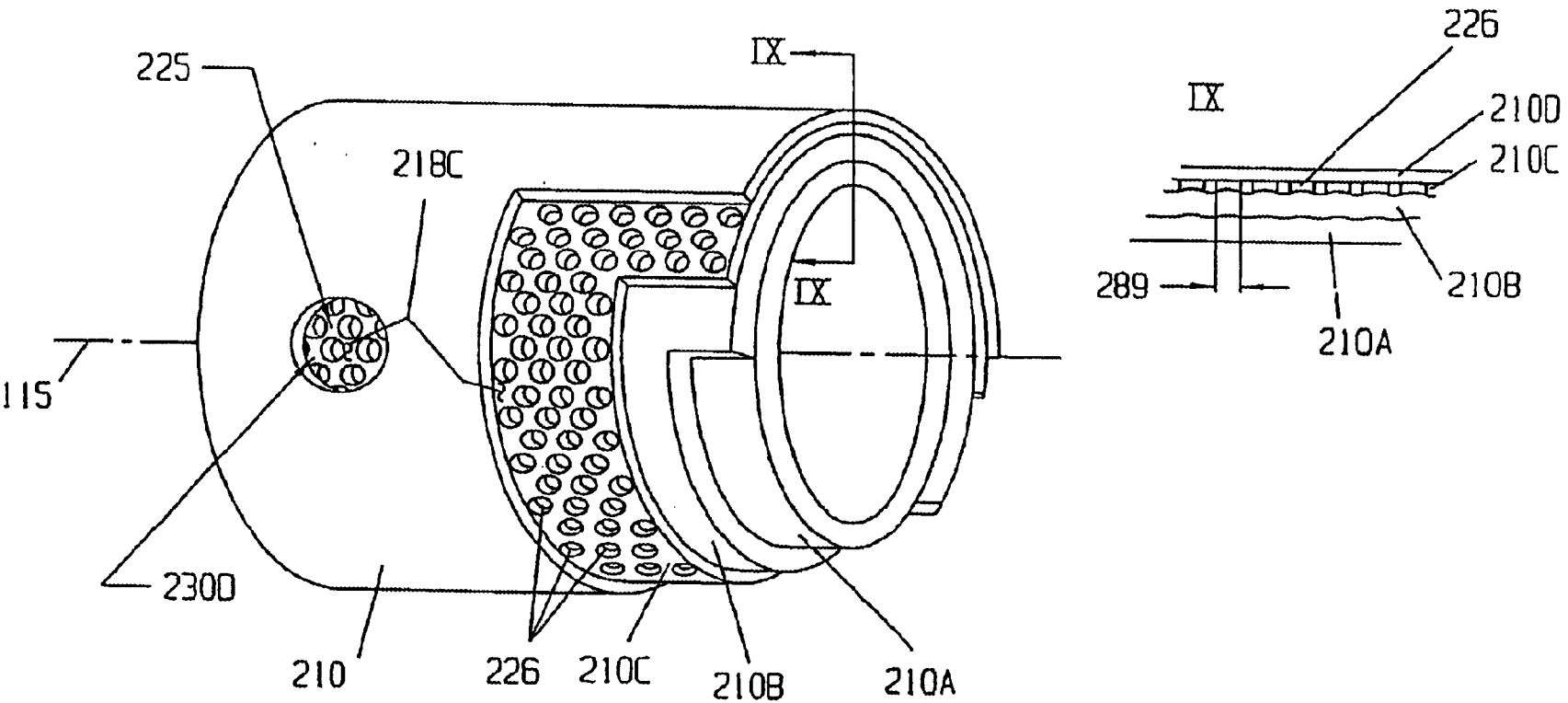
FIG. 6 illustrates a detailed embodiment of the invention employing energy absorption zones.

Wrapping designs and fabrication techniques allow far greater numbers of metals and non-metallic materials to be used as lamination layers, thereby achieving cost savings and reducing production and fabrication times. Improved rupture protection can be achieved without increasing the weight or cost. FIG. 5 and FIG. 6 illustrate two examples of this embodiment.

FIG. 6 illustrates how a perforated or non-continuous material can produce a lamination layer, even though voids may exist within that layer. The layers might consist of continuous sheets with regular perforations, woven sheets of wire, bonded composites, etc. An energy absorption layer 210C contains numerous perforations 226 each having small diameter 289. In another embodiment, not shown, the voids might contain material contributing to material strength at ambient temperature and pressure, but that is readily vaporized by the explosive high-temperature and high-pressure energy pulse, thereby providing minimal energy impedance proximate to the explosive charge, recess and well casing, but maximum shock absorption in other portions of the gun not immediately subjected to the directed high temperature explosive gas jets.

Figure 9A:
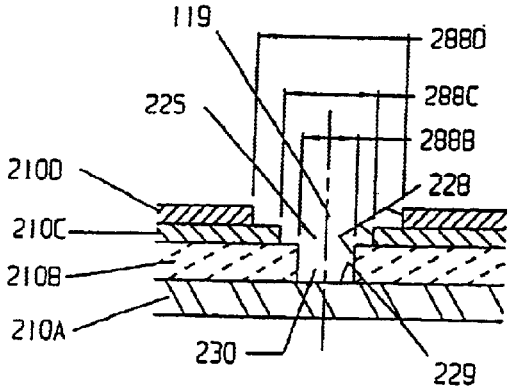
FIGS. 9A–9E employing various designs for precut recesses in gun wall layers.

The energy absorption layer 210C illustrated in FIG. 9A has mechanical properties permitting the inner layers 210B and 210A to expand into the volume occupied by the absorption layer in response to the high impact outward traveling explosive energy pulse occurring upon charge detonation. This mechanical action will consume energy that might otherwise contribute to a catastrophic failure of the outer layer 210D. As already discussed, such failure can hinder the intended perforation of the well casing and the surrounding geologic formation (not shown) or hinder the removal of the gun from the well. These mechanical property enhancements allow higher strength, thinner wall perforating guns with high impact resistance and energy absorption.

In addition to the specific energy absorbing layer shown in FIG. 9A, it will be appreciated that each layer could provide strength or other properties specifically selected by the design engineer to meet conditions of an individual well bore. Therefore, this invention allows wall thickness and composition to become design variables without needing mill runs or large quantities of material.

FIG. 6 also illustrates a recess 225 in the gun wall 210 fabricated from hole 230D cut through selected layers 210D prior to assembly of the combined tubes. The outer surface 218C forms the bottom of the precut recess 230D.

FIG. 7 illustrates an embodiment using helically wound fiber or wire 397 and 398 around an inner layer 210A. The wrapping can also be performed utilizing a removable mandrel. The wrapped layers 210B and 210C can be combined with tubes or cylindrical layers 210A and 210D. The tube layers can incorporate precut hole 230 in the outer layer 210D. The winding may be performed prior to placement of the next outer layer. The fiber or wire can be high strength, high modulus material. This material can provide strength against the explosive pulse. The diameter of fiber or thickness of wrapping can be varied for specific job requirements. The geometry of the winding (or braiding) can be varied, particularly in regard to the orientation to the longitudinal axis 115.

FIG. 8 illustrates a complex gun 200 formed from multiple layers or tubes radially aligned around a longitudinal axis 115. The wall 210 of the gun 200 forms a housing around an annulus 215. The explosive charges, detonator cord, and carrier tube can be placed within this annulus 215. Also illustrated is a recess 225 formed in the manner described previously. The center axis 119 of the illustrated recess 225 is orthogonally oriented 910 to center axis of the gun 115.

Figure 9B:
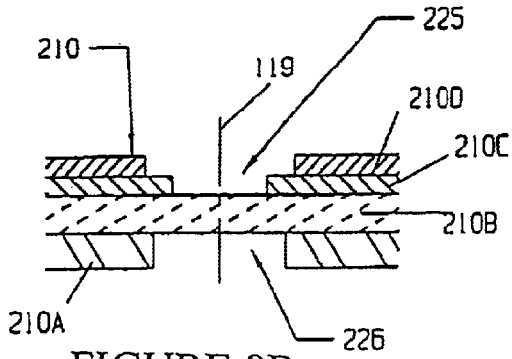

FIG. 9A illustrates an embodiment of the invention wherein the outer three layers 210D, 210C and 210B of the gun wall 210 contain holes cut prior to assembly of the tubes into a single cylinder. Although the diameter 288D, 288C and 288B of each hole is different, the center axis 119 of the combined holes 230 are aligned. The inner layer 210A is not cut, and the outer surface 218A of that tube forms the bottom 229 of the resulting recess 225. The thickness of each precut layer creates a stepped wall 228 of the recess. FIG. 9B illustrates another embodiment wherein the inner tube layer 210A is cut through prior to assembly, a next outer layer 210B is not cut at the location, but the next outermost layers 210C and 210D are cut through and the center axis of the precut holes are aligned 119. This architecture achieves an inner recess 226 within the gun wall 210 aligned with an outer recess 225. This architecture or structure can be readily achieved by this invention. This structure cannot be practically achieved by the prior technology.

Figure 9C:
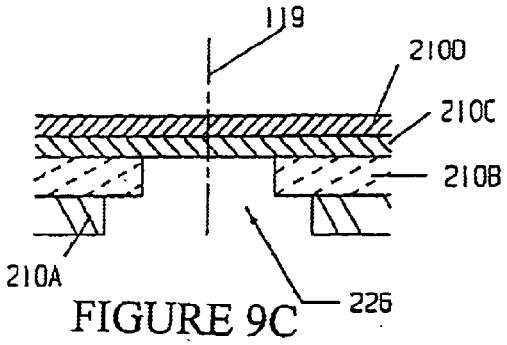

FIG. 9C illustrates another embodiment readily achieved by the invention, but that is not practicable by prior technology. It will be appreciated that the shape of the interior recess 226 can be varied in the same manner as the outer recesses may be formed. Accordingly, the recess diameter can be varied within the interior of the gun wall 210.

Figure 9D:
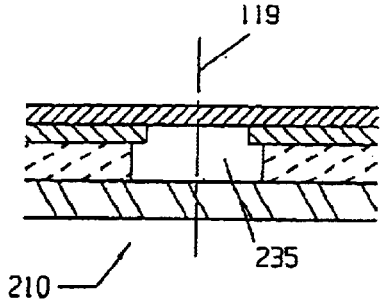
Figure 9E:
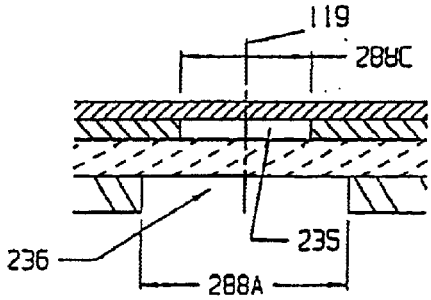

FIG. 9D illustrates a structure that has not been possible prior to the invention. The gun wall 210 can contain an interior recess or cavity 235. The radial axis 119 of the cavity can be aligned with an explosive charge. At the time of assembly, the cavity may be filled with a eutectic material or other material selected to provide strength at ambient conditions but disperse, vaporize or otherwise degrade with the rapid explosive energy pulse. FIG. 9E illustrates a combination interior recess 236 with an internal cavity 235. The interior recess diameter 288A and the internal cavity diameter 288C may be varied as selected by the gun designer.

It will be readily appreciated that the dimensions of each precut hole can be specified. This ability can achieve recesses within multiple layers that, when assembled into the composite gun, the recess walls may possess a desired geometry that may enhance the efficiency of the explosive charge or otherwise impact the directionality of the charge. Further, it will be appreciated that interior recesses may be filled with materials that, when subjected to high temperature, rapidly vaporize or undergo a chemical reaction enhancing o contributing to the original energy pulse.

Figure 10:
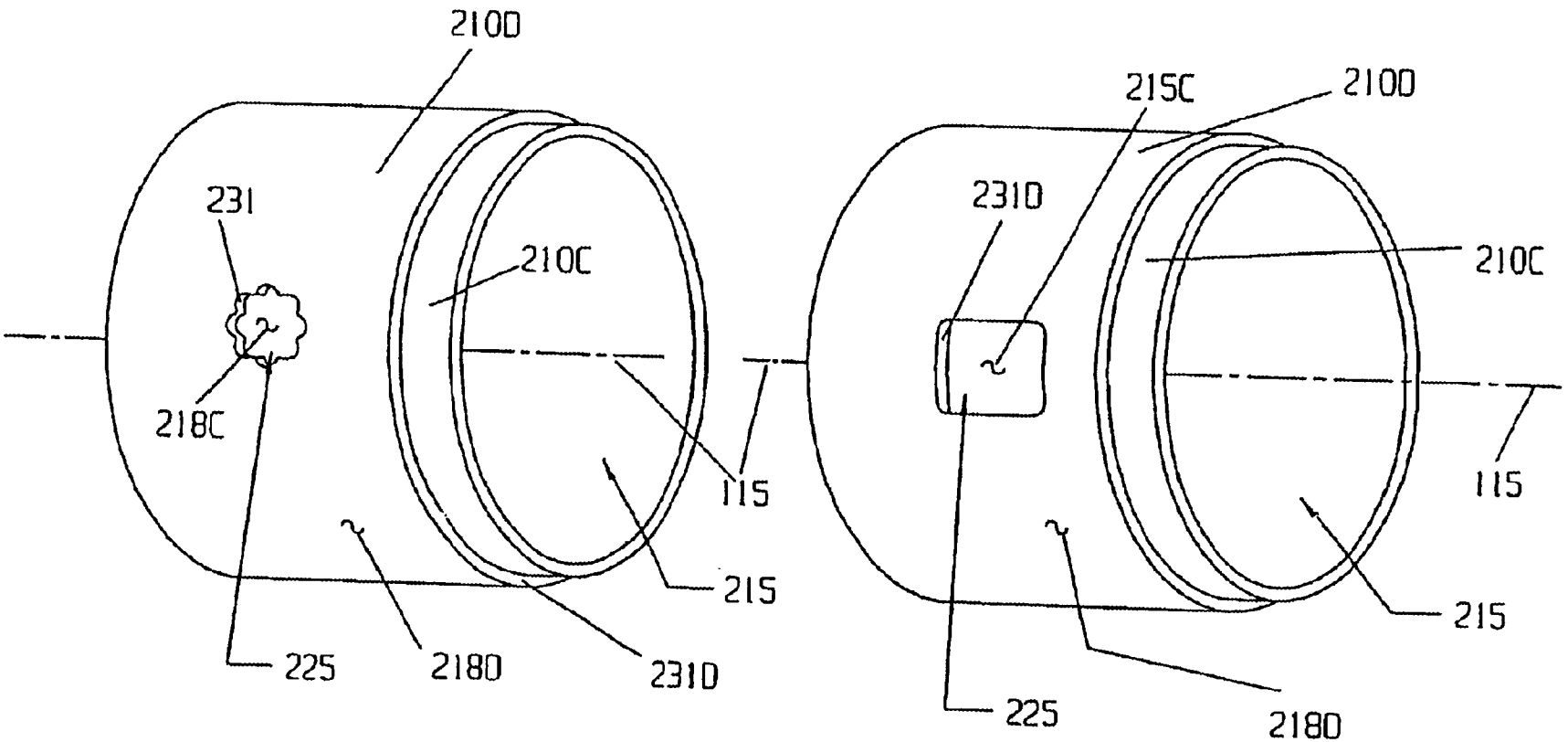
FIG. 10 illustrates a further embodiment of the invention.

FIG. 10 illustrates precut holes forming recesses 225 in the outer layer 210D of the multi-layered gun wall 210D and 210C, having predefined complex outside wall shapes alternative to the circular shaped precut hole. The layer thickness 231D and surface 218D and 218C as well as the annulus 215 and longitudinal axis 115 are also shown. Actual shape design is unlimited since design is no longer restricted by conventional machining methods. Any combination between layers and any shape can be easily produced by laser cutting, tube assembly or layer lamination, and any required material wrapping.

Figure 11:
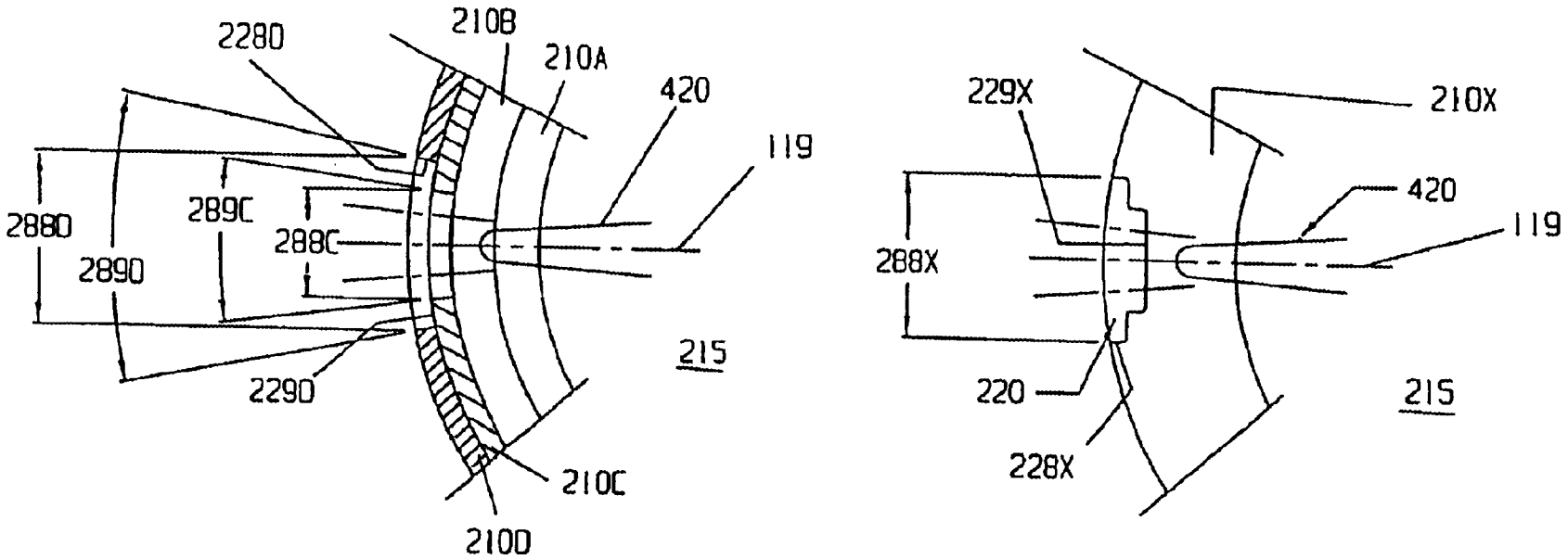
FIG. 11 demonstrates two different scallop configurations with a multi-layered perforation device usable in the method of the invention.
Figure 12:
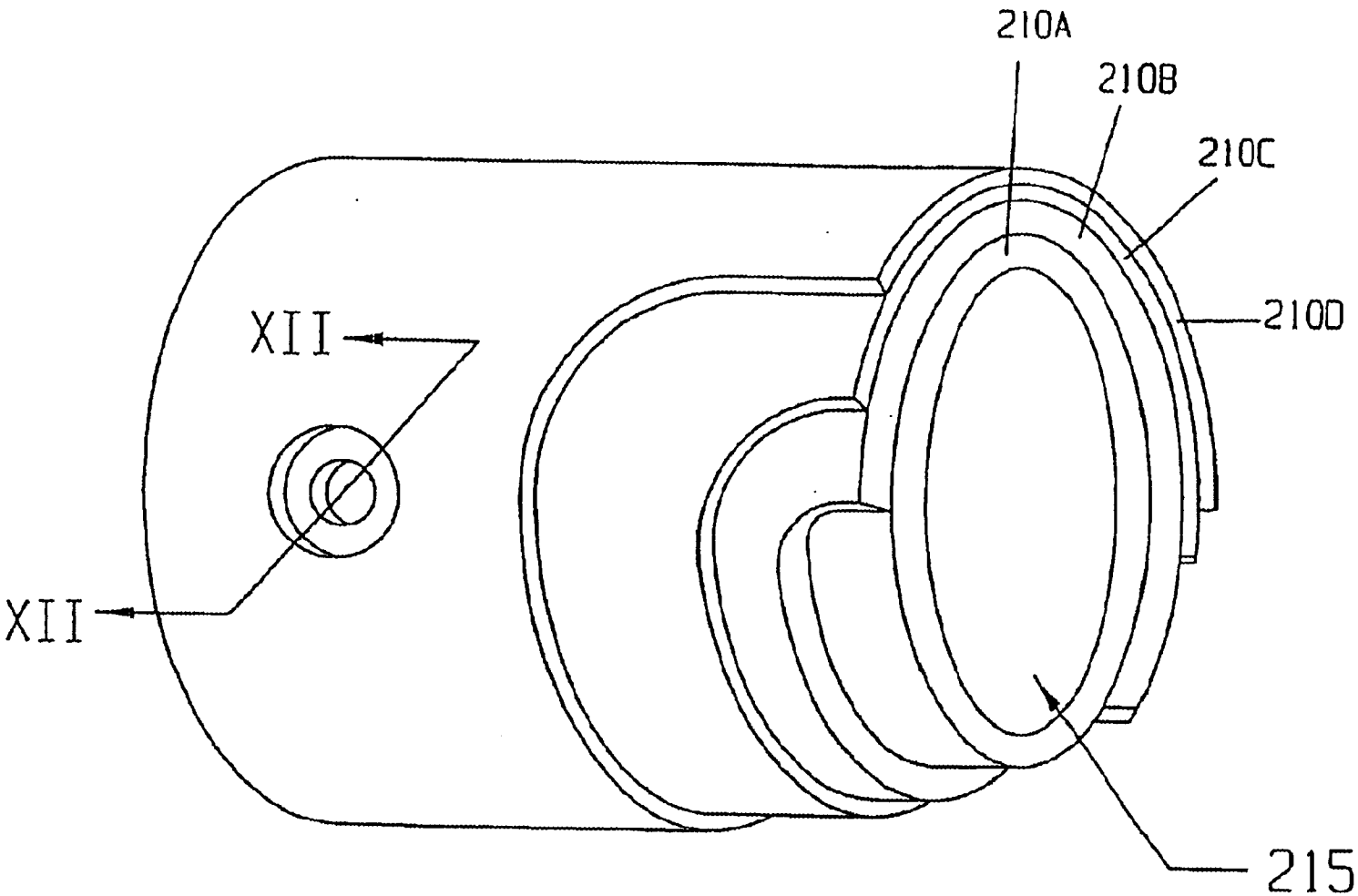
FIG. 12 depicts a side sectional view of a scallop.

FIG. 11 shows that different scallop shapes 225 can be used in the method of the invention.

An additional advantage of the invention is fewer "off-center" shot problems and better charge performance due to scallop wall orientation since the outer tube's recess 229 can achieve a constant underlying wall thickness 210B regardless of the explosive jet 420 exit point. It will be appreciated that if the explosive pulse of the detonated charge is not oriented perpendicular to the outside gun wall, the brief explosive jet pulse will encounter a non uniform gun wall, thereby creating a disruption or turbulence in the flow with resulting dissipation of energy. The invention subject of this disclosure results in a uniform wall thickness, thereby minimizing energy dissipation.

Figure 13A:
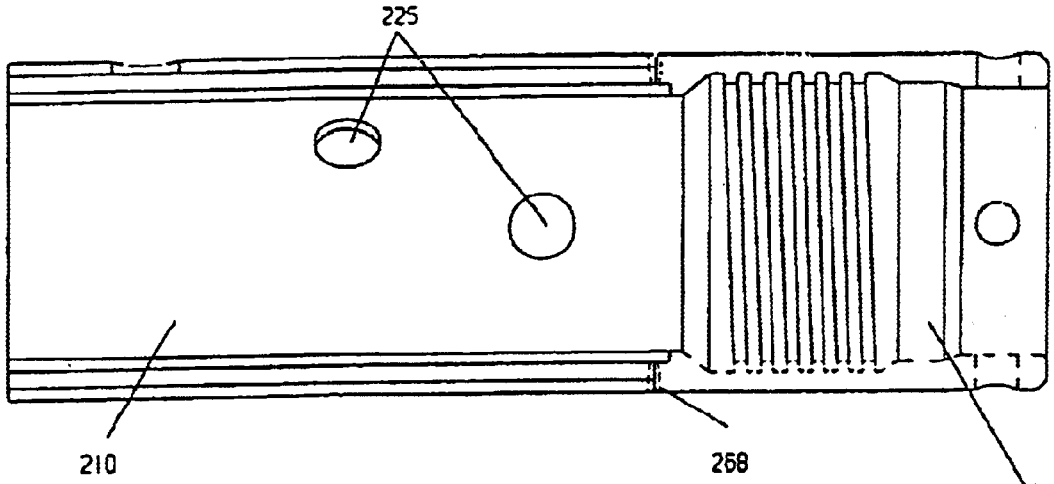
FIGS. 13A and 13B further attachment of end fittings to perforating guns subject of the invention with helically disposed scallops on the outer layer.
Figure 13B:
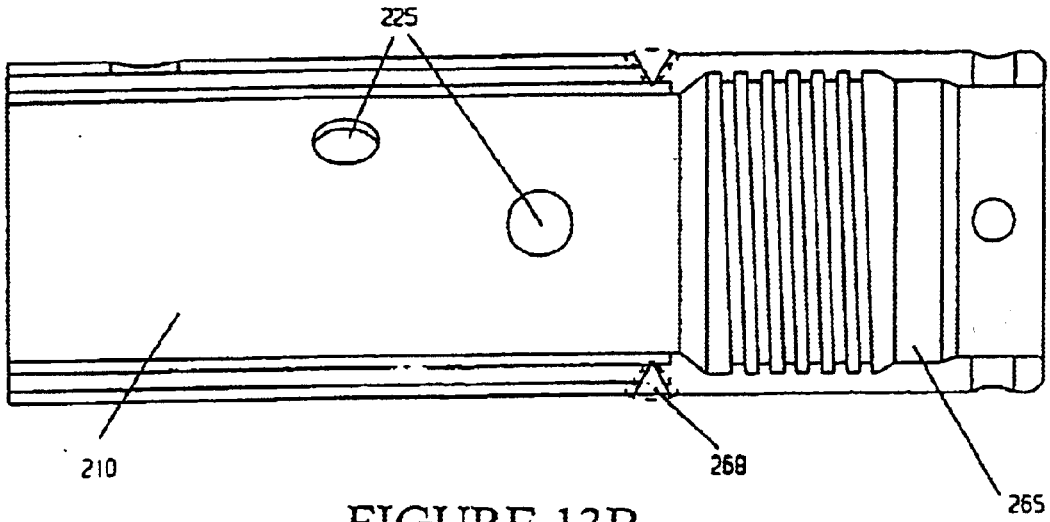

FIG. 13A illustrates a weld seam 268 connecting components 265 to multiple layers of gun wall 210 requiring less machining. This weld can be performed by laser welding, similar to techniques available for precutting of holes 225 within the gun wall 210. The weld seam 268 illustrated in FIG. 13B depicts the size achieved by conventional well technology.

In some embodiments, it may be advantageous to weld or mechanically attach machine threaded connection ends to at least one tube layer. FIG. 13A and FIG. 13B illustrate the use of laser welding gun connection fittings for designs utilizing multiple layers. Laser welding involves low-heat input process, thereby allowing completed machined connection end turnings to be welded directly. Conventional multi-pass welds may require machining after welding to eliminate the effects of distortion.

Other advantages of the invention include more choices of tube supply, especially domestic supplies with far shorter lead times. Lower manufacturing costs are achieved by laser cutting scallops in the outer lamination instead of machining solid, heavy-walled tubes, which is the practice of current technology.

Specific benefits from the construction of guns utilizing multi-layering of differing materials and material costs, reduction of material weight and thickness, decreased dependence upon expensive high strength materials having long lead-time production requirements, and greater flexibility in gun designs including tailoring the properties of the gun wall to accommodate varying field conditions to achieve enhanced performance. In addition, better gun performance is achieved by precut tube scallops having uniform thickness, increased flexibility to create modified scallop walls and shapes, and increased impulse shock absorption by the multiple tube layer interface. Also an inner tube can have higher strength without the adverse effects of brittleness since an outer ductile layer may contain the inner tube.

Since recesses (scallops) can be cut individually into each tube layer before being assembled into a gun tube, many different recess designs are available. One benefit of this recess capability is to produce internal and inner diameter (inner wall) recesses that would be virtually impossible to produce in conventional gun manufacture. It is not the intent of this invention to specifically describe the benefits of all recess designs, but rather to indicate that the advantages will be apparent to persons skilled in the technology of this invention.

Embodiments of the invention further include a method to make a perforating gun for use in oil and natural gas wells. The method generally includes obtaining a length of a first tube, cutting scallop holes into the first tube forming an outer layer, placing the outer layer in a holder, cutting a second tube to a second length of tube which is the approximate length of the outer layer, wrapping wire around the second length of tube and pulling the second length of tube with the wire disposed thereon into the outer layer forming a laminate structure having a first and second end. The method further includes welding a first end coupling to the first end and the second end coupling to the second end and inserting a loading tube into the laminate structure.

In one embodiment, the pulling of the second tube into the first tube is accomplished using a gear reduced drive and chain mechanism.

The method can further include using a length of first tube between 1 foot and 40 feet. In one embodiment, the method includes using a length of second tube between 1 foot and 40 feet. In yet another embodiment, the method includes using first and second tubes with an outer diameter ranging between 1.5 inches and 7 inches.

In one embodiment, the cutting of the scallops is by a laser. In another embodiment, the cutting of the scallops is by a drill. In yet another embodiment, the cutting of the scallops is performed using a mill.

In one embodiment, the cutting of the scallops is at a density of at least 1 per foot of scallops.

In one embodiment, the step of using a holder is performed by using a heavy walled tube that is at least 0.020 larger in diameter than the first tube.

The method can further include the step of forming thread protectors in the first end and the second end of the laminate structure.

In one embodiment, the step of wrapping the wire is performed by winding the wire in a first layer at an angle which is between 0 and 60 degrees from the horizontal axis of the second length of tube. In another embodiment, the step of wrapping the wire is performed by winding the wire in a second layer over the first layer at an angle which is between 0 and 60 degrees from the angle at which the first layer was wound.

In one embodiment, the wrapping of the wire is repeated for up to 8 layers and wherein each layer is at an angle between 0 and 60 degrees from the angle of the prior layer.

The method can further include the step of using an epoxy, a binder, or other adhesive between the wire and the second length of tube.

The method can further include the step of using an epoxy, a binder, or other adhesive between the layers of wire.

It will be appreciated that other medications or variations may be made to the invention disclosed herein without departing from the scope of this invention.

What is claimed is:

1. A method to make a perforating gun for use in oil and natural gas wells comprising the steps of:

a. obtaining a length of a first tube;

b. cutting scallop holes into the first tube forming an outer layer;

c. placing the outer layer in a holder;

d. cutting a second tube to the approximate length of the outer layer;

e. pulling the second tube into the outer layer forming a laminate structure having a first and second end;

f. machining internal structures into the laminate structure; and g. inserting a loading tube into the laminate structure.

2. The method of claim 1, wherein steps d and e are repeated to create a desired number of layers in the laminate structure and then welding a first end coupling to the first end and the second end coupling to the second end.

3. The method of claim 1, wherein the pulling of the second tube into the first tube is accomplished using a gear reduced drive and chain mechanism.

4. The method of claim 1 wherein the method comprises using a length of first tube between 1 foot and 40 feet.

5. The method of claim 1, wherein the method comprises using a length of second tube between 1 foot and 40 feet.

6. The method of claim 1, wherein the method comprises using first and second tubes with an outer diameter ranging between 1.5 inches and 7 inches.

7. The method of claim 1, wherein the cutting of the scallops is by a laser or a drill.

8. The method of claim 1, wherein the cutting of the scallops is performed using a mill.

9. The method of claim 1, wherein the cutting of the scallops is at a density of at least 1 per foot of scallops.

10. The method of claim 1, wherein the step of using a holder is performed by using a heavy walled tube that is at least 0.020 larger in diameter than the first tube.

11. The method of claim 1, further comprising the step of forming thread protectors in the first end and the second end of the laminate structure.

12. The method of claim 11, wherein the step of forming the thread protectors is performed on a lathe.

13. A method to make a perforating gun for use in oil and natural gas wells comprising the steps of:

a. obtaining a length of a first tube;

b. cutting scallop holes into the first tube forming an outer layer;

c. placing the outer layer in a holder;

d. cutting a second tube to a second length of tube which is the approximate length of the outer layer;

e. wrap wire around the second length of tube f. pulling the second length of tube with the wire disposed thereon into the outer layer forming a laminate structure having a first and second end;

g. welding a first end coupling to the first end and the second end coupling to the second end;

h. inserting a loading tube into the laminate structure.

14. The method of claim 13, wherein the pulling of the second tube into the first tube is accomplished using a gear reduced drive and chain mechanism.

15. The method of claim 13 wherein the method comprises using a length of first tube between 1 foot and 40 feet.

16. The method of claim 13, wherein the method comprises using a length of second tube between 1 foot and 40 feet.

17. The method of claim 13, wherein the method comprises using first and second tubes with an outer diameter ranging between 1.5 inches and 7 inches.

18. The method of claim 13, wherein the cutting of the scallops is by a laser.

19. The method of claim 18, wherein the cutting of the scallops is by a drill.

20. The method of claim 18, wherein the cutting of the scallops is performed using a mill.

21. The method of claim 13, wherein the cutting of the scallops is at a density of at least 1 per foot of scallops.

22. The method of claim 13, wherein the step of using a holder is performed by using a heavy walled tube that is at least 0.020 larger in diameter than the first tube.

23. The method of claim 13, further comprising the step of forming thread protectors in the first end and the second end of the laminate structure.

24. The method of claim 13, wherein the step of wrapping the wire is performed by winding the wire in a first layer at an angle which is between 0 and 60 degrees from the horizontal axis of the second length of tube.

25. The method of claim 24, wherein the step of wrapping the wire is performed by winding the wire in a second layer over the first layer at an angle which is between 0 and 60 degrees from the angle at which the first layer was wound.

26. The method of claim 25, wherein the wrapping of the wire is repeated for up to 8 layers and wherein each layer is at an angle between 0 and 60 degrees from the angle of the prior layer.

27. The method of claim 13, further comprising the step of using an epoxy, a binder, or other adhesive between the wire and the second length of tube.

28. The method of claim 25, further comprising the step of using an epoxy, a binder, or other adhesive between the layers of wire.

* * * * *